US005931013A

United States Patent [19]

Wickman

[11] Patent Number: 5,931,013

[45] Date of Patent: Aug. 3, 1999

[54] REFRIGERATOR DISPLAY CABINET

[75] Inventor: Lars Åke Wickman, Arvika, Sweden

[73] Assignee: Aktiebolaget Electrolux, Stockholm, Sweden

[21] Appl. No.: 09/015,158

[22] Filed: Jan. 29, 1998

[30] Foreign Application Priority Data

Mar. 7, 1997 [SE] Sweden ..... 9700814

[51] Int. Cl.[6] ..... A47F 3/04

[52] U.S. Cl. ..... 62/255; 62/256

[58] Field of Search ..... 62/255, 256

[56] References Cited

U.S. PATENT DOCUMENTS

| | | | |
|---|---|---|---|
| 3,769,805 | 11/1973 | Corini | 62/255 |
| 4,267,706 | 5/1981 | Abraham | 62/256 |
| 4,736,592 | 4/1988 | Ohling | 62/62 |

FOREIGN PATENT DOCUMENTS

| | | |
|---|---|---|
| 86955 | 2/1956 | Norway . |
| 97/00038 | 1/1997 | WIPO . |

*Primary Examiner*—William E. Tapolcai

*Attorney, Agent, or Firm*—Pearne, Gordon, McCCoy & Granger LLP

[57] ABSTRACT

A refrigerator display cabinet (10) for furnishing refrigerated goods has a vertical duct (20), which is surrounded by a magazine (24, 34) which is filled with the goods from above, and at its lower part is surrounded by a bottom (18), on which the goods rest and which at its periphery has an opening (38) for taking the goods out. A fan (12) is arranged to bring air which is refrigerated by a cooling element (22) to flow upwards through the duct (20) and then between goods located in the upper part of the magazine, from where the air flows downwards between goods located in the lower part of the magazine and out through holes (26) in the bottom and then back to the fan (12). Means (46) are arranged to reverse the circulation direction of the air from time to time so that the air periodically will flow in opposite direction through the display cabinet (10).

2 Claims, 1 Drawing Sheet

REFRIGERATOR DISPLAY CABINET

Refrigerator display cabinet for furnishing goods having a vertical duct, which is surrounded by a magazine which is filled with the goods from above, and at its lower part is surrounded by a bottom, on which the goods rest and at its periphery has an opening for taking the goods out, an impeller of a fan being arranged to bring air which is refrigerated by a cooling element to flow in a first circulation direction upwards through the duct and then between goods located in the upper part of the magazine, from where the air flows downwards between goods located in the lower part of the magazine and out through holes in the bottom and then back to the fan.

Such a display cabinet is known through WO 97/00038. Goods located in the upper part of the magazine will heat the air which flows between them, for what reason goods located in the lower part of the magazine will not be refrigerated to the same low temperature as goods located in the upper part of the magazine.

The object of the invention is to improve the known display cabinet so that goods located in the lower part of the magazine get substantially the same temperature as goods located in the upper part of the magazine.

This object is reached by the display cabinet according to the invention thereby that means are arranged to reverse the rotation direction of the impeller from time to time so that the air during periods will flow through the cabinet in a second circulation direction, which is opposite to the first circulation direction, which periods are longer than the periods the air is circulated in the first circulation direction.

By this different sides of goods located in as well the lower as in the upper part of the magazine will alternately be exposed to the coldest air, i.e. air coming directly from the cooling element, goods located in the lower part of the magazine, which goods through their position at the opening for taking the goods out will be heated more by heat radiation from the surroundings than goods at other places in the cabinet, thereby becoming most exposed to the coldest air, through which substantially the same temperature can be maintained of all goods in the display cabinet.

Figure 1:
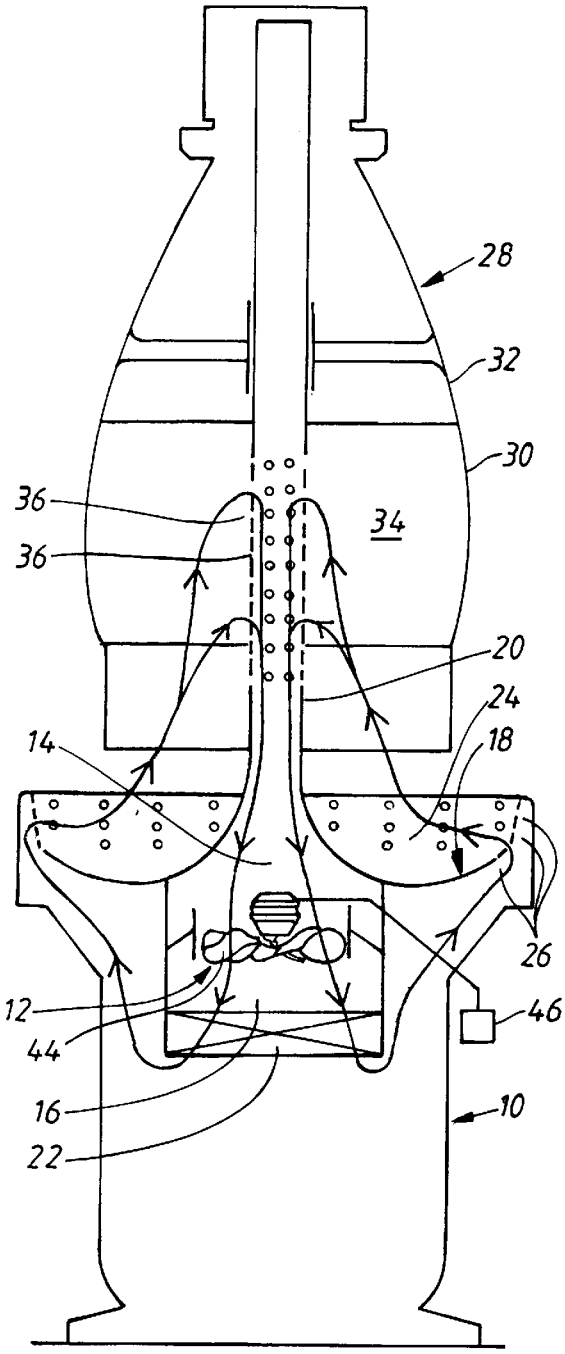
Figure 2:
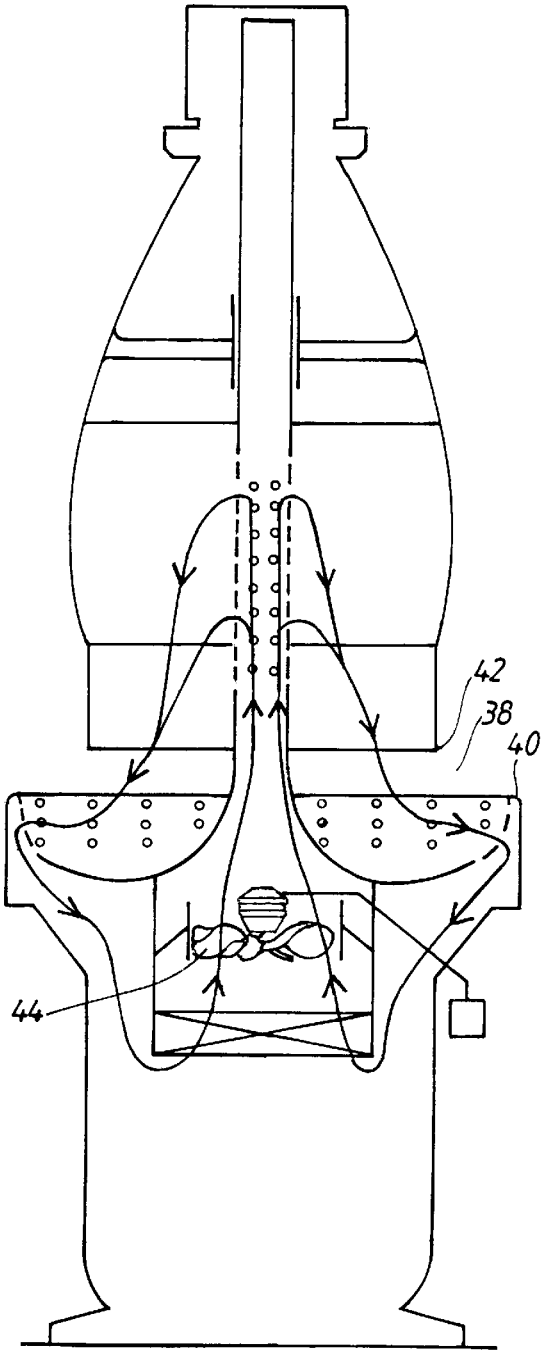

An embodiment of a refrigerator display cabinet according to the invention is described below in connexion with the enclosed drawing, in which FIG. 1 shows a vertical sectional view of the display cabinet, refrigerated air being brought to circulate through the display cabinet in a first direction, and FIG. 2 shows the same display cabinet as FIG. 1, the air being brought to circulate in a second, opposite direction through the display cabinet.

By 10 is designated an underbody, in which an axial fan 12 is arranged between an upper chamber 14 and a lower chamber 16. The underbody has at its top an annular bottom 18, which extends around a tube 20, which sticks up from the underbody 10 and communicates with the chamber 14. The chamber 16 communicates via a cooling element 22 with a space 24 above the bottom 18 through perforations 26 in an outer annular part of the bottom 18.

The tube 20 is surrounded by a hood 28 having an annular cross section, which hood 28 has a lower, stationary part 30 and an upper part 32, which is slidably journalled on the tube 20. The part 30 encloses a space 34, which communicates with the tube 20 through perforations 36 in the wall of the tube 20.

The display cabinet is intended for furnishing goods, e.g. packages with provisions, which are located in the spaces 24 and 34. The goods are taken out by a customer through an annular opening 38, which extends 360° around the tube 20 and is formed between an outer, circular edge 40 of the bottom 18 and a lower, circular edge 42 of the part 30 of the hood. When the goods are taken out from the space 24 the goods sink from the space 34 down into the space 24. New goods are filled in at the top of the space 34, which becomes available by the part 32 being lifted.

The goods are cooled by air, which is circulated by the impeller 44 of the fan 12, which air in its turn is refrigerated by a cooling element 22, which for instance can be constituted by an evaporator of a refrigerant circuit. A means 46 is arranged to reverse the direction of rotation of the impeller 44 from time to time, so that the circulation direction of the air is reversed.

When the impeller 44 is rotated in one direction, see FIG. 1, the air flows from the impeller 44 through the chamber 16 and the cooling element 22, where the air is refrigerated, and continues through the perforations 26 in the bottom 18 to the space 24, from where the air flows upwards through the space 34 and in through the perforations 36 in the tube 20, from where the air flows back to the impeller 44 via the chamber 14.

When the impeller 44 is rotated in the other direction, see FIG. 2, the flow direction of the air will be contrary to the one described above.

By this different sides of the goods in the spaces 24 and 34 will alternately be exposed to the coldest air, i.e. air which comes directly from the cooling element 22. Goods located in the space 24 will, through their position at the opening 38, be more heated by heat radiation from the surroundings than goods in the space 34. This local heating in the space 24 is kept back by the periods during which the air flows in the direction shown in FIG. 1 being longer than the periods the air flows in the direction shown in FIG. 2, the goods in the space 24 thereby becoming most exposed to the coldest air, through which substantially the same temperature of the goods can be maintained in both spaces 24 and 34. In this way it has proved to be possible to furnish provisions, which require cold storage, e.g. packages with milk products at about +6° C., in the display cabinet.

The periods during which the cooling air by reversing of the direction of rotation of the impeller 44 is brought to flow in the one or the other direction can be optimized for different embodiments of the refrigerator display cabinet according to the invention. At one embodiment all the goods in the display cabinet have proved to get substantially the same temperature, when the air first is allowed to flow for 25 minutes in the direction which is shown in FIG. 1 and after that for 15 minutes in the direction which is shown in FIG. 2.

The display cabinet according to FIG. 1 and 2 has a circular cross section shape in different horizontal planes. This cross section shape can also be other than circular, for instance square as at the display cabinet according to FIG. 1–4 of said WO 97/00038.

I claim:

1. Refrigerator display cabinet (10) for furnishing goods having a vertical duct (20), which is surrounded by a magazine (24, 34) which is filled with the goods from above, and at its lower part is surrounded by a bottom (18), on which the goods rest and at its periphery has constantly open opening (38) for taking the goods out, an impeller (44) of a fan (12) being arranged to bring air which is refrigerated by a cooling element (22) to flow in a first circulation direction upwards through the duct (20) and then between goods located in the upper part of the magazine, from where the air flows downwards between goods located in the lower part of the magazine and out through holes (26) in the bottom (18)

and then back to the fan (12), wherein means (46) are arranged to reverse the rotation direction of the impeller (44) from time to time so that the air during periods will flow through the cabinet (10) in a second circulation direction, which is opposite to the first circulation direction, which periods are longer than the periods the air is circulated in the first circulation direction.

2. Refrigerator display cabinet according to claim 1, wherein the air flow passes through holes (36) in the wall of the duct (20), said holes (36) being located at the level of the upper part (34) of the magazine.

* * * * *